US009089740B2

(12) United States Patent
Frank et al.

(10) Patent No.: US 9,089,740 B2
(45) Date of Patent: Jul. 28, 2015

(54) GAME BALL

(71) Applicant: PSI 91, Inc., Springfield, MA (US)

(72) Inventors: John P. Frank, Vernon, CT (US); Daniel P. Touhey, Florence, MA (US)

(73) Assignee: PSI 91, Inc., Springfield, MA (US)

( * ) Notice: Subject to any disclaimer, the term of this patent is extended or adjusted under 35 U.S.C. 154(b) by 0 days.

(21) Appl. No.: 14/284,794

(22) Filed: May 22, 2014

(65) Prior Publication Data

US 2015/0031481 A1 Jan. 29, 2015

Related U.S. Application Data

(60) Provisional application No. 61/859,487, filed on Jul. 29, 2013.

(51) Int. Cl.

| | |
|---|---|
| ***A63B 41/00*** | (2006.01) |
| ***A63B 41/08*** | (2006.01) |
| ***A63B 43/00*** | (2006.01) |
| ***A63B 45/00*** | (2006.01) |

(52) U.S. Cl.

CPC ..... *A63B 43/002* (2013.01); *A63B 41/08* (2013.01); *A63B 45/00* (2013.01)

(58) Field of Classification Search

CPC ..... A63B 41/08; A63B 43/002; A63B 45/00
USPC ..... 473/603, 596, 597, 598, 599, 600, 604; D21/707, 712

See application file for complete search history.

(56) References Cited

U.S. PATENT DOCUMENTS

| | | | | | |
|---|---|---|---|---|---|
| 1,559,117 | A | * | 10/1925 | Maynard | 473/596 |
| 1,924,923 | A | * | 8/1933 | Gibbons | 264/183 |
| 1,924,924 | A | * | 8/1933 | Gibbons | 264/201 |
| 1,931,429 | A | * | 10/1933 | Buckner et al. | 473/596 |
| 2,011,760 | A | * | 8/1935 | Gallinant | 473/596 |
| 2,194,674 | A | * | 3/1940 | Riddell | 473/597 |
| 2,238,885 | A | * | 4/1941 | James et al. | 156/167 |
| 2,244,503 | A | * | 6/1941 | Riddell | 473/597 |
| 2,270,553 | A | * | 1/1942 | Potito | 473/596 |
| 2,313,296 | A | * | 3/1943 | Lamesch | 428/398 |
| 2,428,046 | A | * | 9/1947 | Webb et al. | 428/370 |
| 2,674,025 | A | * | 4/1954 | Ladisch | 428/376 |
| 2,931,653 | A | * | 4/1960 | Gow et al. | 473/596 |
| 3,091,017 | A | * | 5/1963 | Wetterau | 156/148 |
| 3,091,019 | A | * | 5/1963 | Wetterau | 442/185 |
| 5,069,935 | A | * | 12/1991 | Walters | 427/209 |
| 5,679,196 | A | * | 10/1997 | Wilhelm et al. | 156/167 |
| 6,123,632 | A | * | 9/2000 | Feeney et al. | 473/596 |
| 6,634,970 | B2 | * | 10/2003 | Jiminez | 473/597 |
| 6,663,519 | B2 | * | 12/2003 | Kuhn et al. | 473/597 |
| 6,761,654 | B2 | * | 7/2004 | Murphy et al. | 473/596 |
| 6,767,300 | B2 | * | 7/2004 | Murphy et al. | 473/597 |
| 6,964,625 | B2 | * | 11/2005 | Murphy et al. | 473/597 |
| 7,029,407 | B2 | * | 4/2006 | Lee et al. | 473/597 |

(Continued)

*Primary Examiner* — Steven Wong
(74) *Attorney, Agent, or Firm* — Richard M. Klein; Fay Sharpe LLP

(57) ABSTRACT

The present disclosure relates to a game ball and methods for stitching a thread with a high coefficient of friction upon a stripe member present on the game ball. At least one stitching is thus formed upon the stripe member. The stitching formed from the thread enhances the grip and/or spin characteristics of the resulting game ball, improving handling and playability.

12 Claims, 23 Drawing Sheets

(56) References Cited

U.S. PATENT DOCUMENTS

| | | | | |
|---|---|---|---|---|
| 8,366,574 | B2 | 2/2013 | Guenther et al. | |
| 8,460,135 | B2 | 6/2013 | Guenther et al. | |
| 2004/0121865 | A1* | 6/2004 | Lee et al. | 473/597 |
| 2006/0046879 | A1* | 3/2006 | Kelly et al. | 473/603 |
| 2006/0211527 | A1* | 9/2006 | Guenther et al. | 473/597 |
| 2013/0228422 | A1* | 9/2013 | Mathieu et al. | 198/846 |
| 2013/0324333 | A1* | 12/2013 | McNamee | 473/599 |
| 2014/0066238 | A1* | 3/2014 | Smith et al. | 473/597 |

* cited by examiner

GAME BALL

CROSS-REFERENCE TO RELATED APPLICATIONS

This application claims priority to U.S. Provisional Patent Application Ser. No. 61/859,487, filed on Jul. 29, 2013. The entirety of that application is hereby fully incorporated by reference in its entirety.

BACKGROUND

The present disclosure relates generally to improved inflatable game balls, and more particularly to methods of stitching using a soft, compressible, and/or elastic thread upon stripes present on the cover panels of such game balls. The thread and/or resulting stitching may have an enhanced static coefficient of friction (or frictional coefficient) over other components of the ball. These methods are particularly useful for enhancing the grippability of the covers of certain inflated game balls or sportsballs, such as those used for throwing, kicking, and catching in the games of rugby, American football, or Canadian football.

In this regard, a football or rugby ball has a generally prolate spheroid shape (i.e. egg-shaped) with lacing on one side of the ball. The specific size, shape, and construction of the ball differ depending upon league rules and regulations. Such balls are designed to meet certain specifications. For example, the National Collegiate Athletic Association (NCAA) requires that all footballs used for gameplay are marked with two 1-inch white stripes covering one-half the circumference (i.e. the top panels) of the ball. These stripes are located about 3 inches from the end of the ball. Some rugby balls do not have lacing or stripes.

When used in play, a football and/or rugby ball is contacted by players in a variety of different ways and using a variety of techniques. For example, a football player can carry, hold, throw, and/or catch the game ball frequently during the course of a game.

The feel or touch of the game ball can affect the tempo and result of the game. For example, if the surface of a game ball is too smooth, it may be very difficult for a receiver to catch a football or for a running back to maintain the ball in his hands while running. Similarly, if the game ball has a surface that is too slick, the quarterback may have difficulty throwing the football with the desired degree of precision, or a kicker may have difficulty kicking the ball accurately. This is especially true during play in inclement weather conditions.

The grip of the game ball is of course heavily affected by the surface of the game ball. When the game ball is marked with stripes or other graphics, the ball exhibits areas of different texture and feel. These inconsistent surface characteristics can make it difficult to catch and grip the game ball. As a result of these inconsistent surface characteristics throughout the ball, different methods have been tried to improve the grip of surfaces of the game ball having stripes applied to them. Those methods have included matte finish inks, cheese cloth mesh stamping, and printing with transfer inks. However, these methods have resulted in marginal grip capabilities, slippery areas and poor durability of the graphics.

It would be desirable to provide alternative methods for improving the grip characteristics of a game ball.

SUMMARY

The present disclosure relates to a game ball, such as a football, that uses a soft, compressible, and elastic thread to form a stitching upon the outer surface of the game ball. The stitching is preferably raised above the outer surface, and has a greater static coefficient of friction than the cover layer or the stripe areas of the game ball, and thus has improved grip or texture. The stitching provides an improved gripping surface for the user/player, such as around or in the stripe areas. The stitching also facilitates the player's abilities in certain situations, e.g. to spin or spiral the ball when thrown, which generally causes the ball to travel straighter and farther. Hence, the resulting game ball has enhanced handling and playability characteristics.

Along these lines, disclosed in various embodiments herein is a game ball, comprising: an inflatable bladder; and a cover layer surrounding the bladder, the cover layer being formed from a plurality of cover panels; wherein at least one of the cover panels includes (i) a first stripe member attached to an outer surface of the cover panel, the first stripe member having a first stripe edge and a second stripe edge adjacent the outer surface, and (ii) at least one stitching, preferably raised, upon the first stripe member formed using a thread that has a static coefficient of friction greater than the static coefficient of friction of the outer surface of the cover panel or the static coefficient of friction of the first stripe member.

The at least one cover panel may have at least a first stitching along the first stripe edge and a second stitching along the second stripe edge, each stitching being made from a thread, which may be of the same or different compositions.

In some embodiments, the first stitching runs along the first stripe edge in a zig-zag pattern between the first stripe member and the outer surface of the at least one cover panel, and the second stitching runs along the second stripe edge in a zig-zag pattern between the first stripe member and the outer surface of the at least one cover panel. Other patterns are also contemplated for the stitchings. Again, the stitchings may be of the same or different compositions.

In other embodiments, the at least one cover panel has three stitches, two stitches along the stripe edges and the third stitch being located along the center of the first stripe member. The third stitch can have a zig-zag pattern.

The first stripe member may have a static coefficient of friction that is equal to, less than, or greater than the static coefficient of friction of the outer surface of the cover panel. The stitchings can be formed from a thread that is coated with a texture-enhancing polymer or other material to provide an enhanced coefficient of friction over other surface components of the ball. Alternatively, the thread may be of uniform composition, such as an extruded polymeric thread. The first stripe member can be formed from a polyurethane, a polyvinyl chloride, a rubber, or an elastomer.

In other contemplated embodiments, the at least one cover panel has a total of five stitchings spaced upon the first stripe member, in the same or different configurations.

The at least one cover panel usually further includes a second stripe member located at an opposite end of the cover panel from the first stripe member.

The cover layer of the game ball is usually formed from a total of four cover panels, with two of the cover panels including the first stripe member and the at least one stitching. The first stripe member may have a different texture from the outer surface of the at least one cover panel.

Also disclosed in embodiments herein are methods for preparing a cover panel, comprising: attaching a first stripe member to an outer surface of the cover panel, the first stripe member having a first stripe edge and a second stripe edge adjacent the outer surface; and sewing at least one raised stitching upon the first stripe member with a coated thread that has a static coefficient of friction greater than conventional stitching, and preferably greater than the static coefficient of friction of the outer surface of the cover panel or the static coefficient of friction of the first stripe member.

The at least one raised stitching can be located along the first stripe edge, along the second stripe edge, or along the center of the first stripe member.

In embodiments, at least a first raised stitching is sewed along the first stripe edge and a second raised stitching is sewed along the second stripe edge. The first stitching can run along the first stripe edge in a zig-zag pattern between the first stripe member and the outer surface of the at least one cover panel, and the second stitching can run along the second stripe edge in a zig-zag pattern between the first stripe member and the outer surface of the at least one cover panel. If desired, a third raised stitching can be sewed located along the center of the first stripe member. The third stitching can have a zig-zag pattern.

Sometimes, a total of five or more raised stitchings are sewed upon the first stripe member, the five stitchings being spaced apart from each other in a regular or irregular pattern.

The methods may further comprise: attaching a second stripe member to the outer surface of the cover panel at an opposite end from the first stripe member, the second stripe member having a first stripe edge and a second stripe edge adjacent the outer surface; and sewing at least one raised stitching upon the second stripe member with a thread that has a static coefficient of friction greater than the static coefficient of friction of the outer surface of the cover panel or the static coefficient of friction of the second stripe member.

These and other non-limiting characteristics are more particularly described below.

DESCRIPTION OF THE DRAWINGS

The following is a brief description of the drawings, which are presented for the purpose of illustrating the exemplary embodiments disclosed herein and not for the purpose of limiting the same.

DETAILED DESCRIPTION

Figure 1:
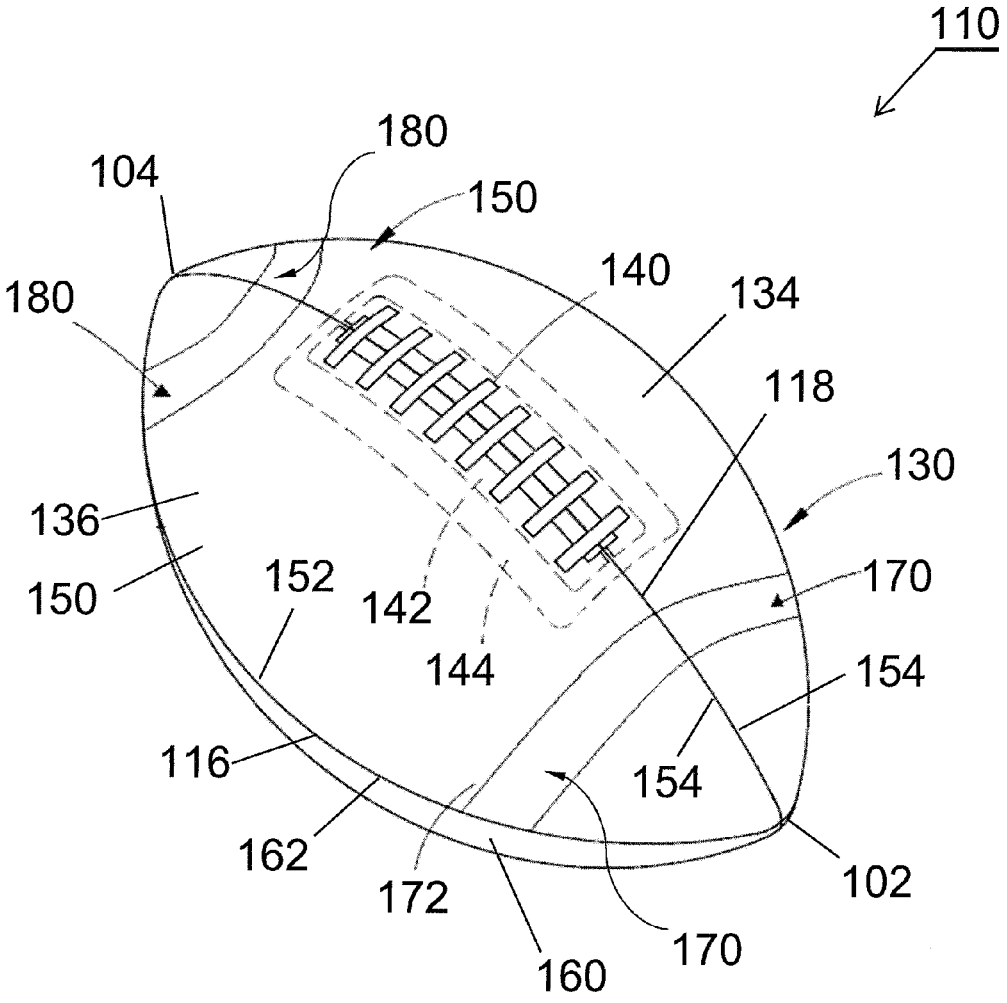
FIG. 1 is an exterior view of an American football with which the threading/stitching of the present disclosure having an enhanced coefficient of friction can be used. The stitchings are located upon the stripes of the football.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The singular forms "a," "an," and "the" include plural referents unless the context clearly dictates otherwise.

As used in the specification and in the claims, the term "comprising" may include the embodiments "consisting of" and "consisting essentially of."

Some of the terms used herein are relative terms. For example, the terms "interior", "exterior", "inner", and "outer" are relative to a center. These terms should not be construed as requiring a particular orientation.

The stripes on a game ball, such as a football, have traditionally been painted. However, such paints can feel slick and less tacky compared to the cover panel of the ball. More recently, composite or rubber materials have been used to create the stripe, with the stripe being held in place by adhesion, thermal bonding, press fitting, or stitching. However, the cotton thread used in stitching can be slick, negating the advantage of a more grippable stripe. The present disclosure relates to game balls having stitchings (e.g. raised stitchings) made from a tactile thread (e.g. a coated thread), and to methods of making such game balls. The stitches are located upon stripes on the game ball, and have a greater static coefficient of friction than the outer surface of the game ball and/or the stripe. This enhances the grippability and overall feel of the game ball.

A stripe described herein is a line applied to the game ball to increase visibility or represent league affiliation. For example, white stripes on American footballs are required for "NCAA®" collegiate football competition, but are not found on footballs used at the professional level National Football League ("NFL"). The term "stripe" or "stripes" is used here to refer to the roughly 1-inch-thick lines that are added to the outer/exterior surface of a cover panel of an American football and located about 3 to 3.25 inches from the end of the cover panel.

Figure 2:
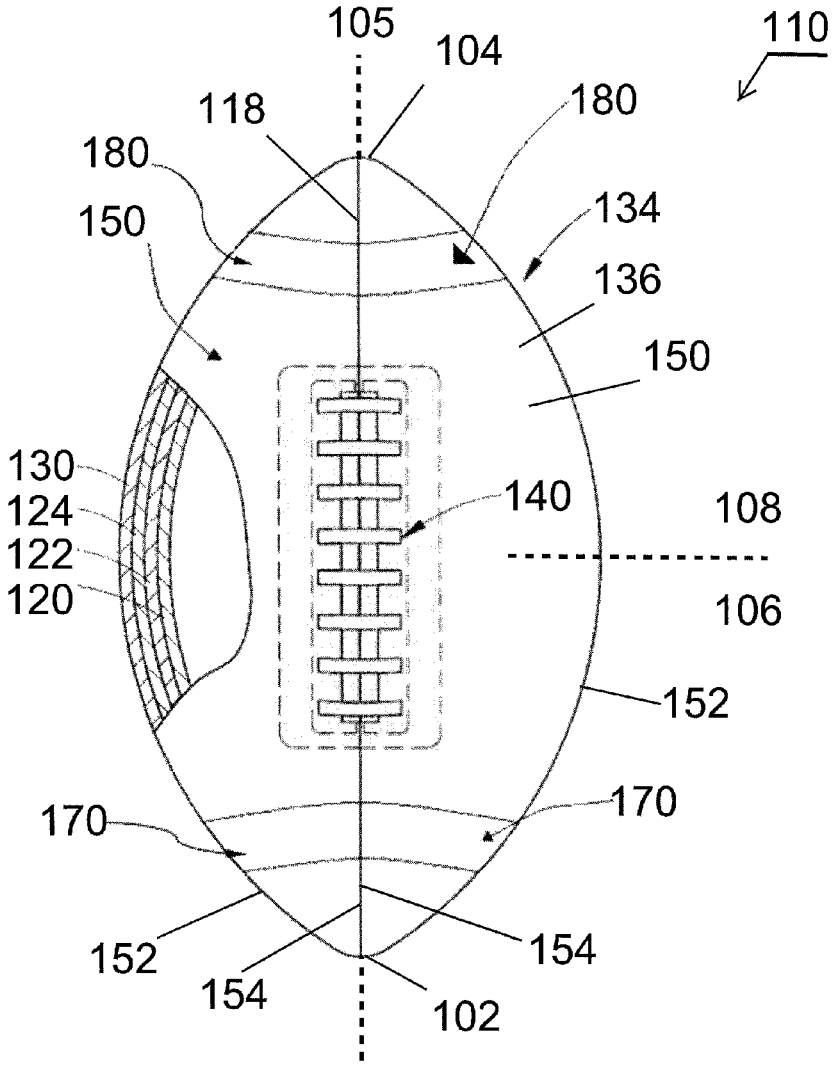
FIG. 2 is a top view and a partial cross-sectional view of the football of FIG. 1.

FIG. 1 is an exterior view of a conventional American football, and provides reference points for the discussion of the threads/stitchings of the present disclosure having enhanced friction. FIG. 2 is a cross-sectional view of the same football 110. A cover layer 130 makes up the outer/exterior surface of the football. Inside the football (i.e. under the cover layer) is a bladder 120. Surrounding the bladder 120 is a cloth liner 122, then a foam liner 124, then the cover layer 130. The cloth liner, foam liner, and cover layer are generally made in multiple pieces that are combined to make a panel 134; four panels 134 are used to form the cover layer 130 that covers the football 110. The outer surface 136 of the cover panels makes up the outer surface of the football. The four panels are joined together by stitching on three seams and by a combination of stitching and lacing at the fourth seam. The lacing area includes the lacing 140, optionally a patch material 142 stitched to the underside of the panels 134 through which lacing 140 penetrates, and optionally a tongue 144 located between the bladder 120 and the lacing 140 which has penetrated the patch material 142. Stitching may be present on the cover panels proximate the lacing, for example to hold the patch material and/or common in place relative to the cover panel.

Of the four panels in this embodiment, two are considered to be top panels 150, and two are considered to be bottom panels 160. A top panel 150 contacts the lacing 140, wherein a bottom panel does not contact the lacing. Each top panel 150 has a horizontal edge 152 which contacts a bottom panel, and a vertical edge 154 which contacts the lacing 140. Each bottom panel 160 has a horizontal edge 162 which contacts a top panel. Each bottom panel here also has a vertical edge (not shown) which contacts another bottom panel. However, it is contemplated that in embodiments having different numbers of panels (e.g. three or five panels), it is possible that a bottom panel will be flanked on both sides by only top panels or only bottom panels. The game ball has two horizontal seams 116 and two vertical seams 118. Each horizontal seam 116 is formed where the horizontal edges of two cover panels meet, and each vertical seam 118 is formed where the vertical edges of two cover panels meet. It should be noted that the lacing 140 is located along one of the vertical seams. The top half of the game ball contains the lacing 140 at the center, while the bottom half of the game ball does not contain the lacing. Here, a plane passing through the two horizontal seams 116 will divide the ball into the top half and the bottom half.

A longitudinal axis 105 extends through the two longitudinal ends 102, 104 of the game ball. The game ball can also be bisected into two longitudinal sides 106, 108 which are generally mirror images of each other (with the exception of graphics, logos, etc.), shown in FIG. 2 on either side of a dotted line. Each top panel has two stripe members 170, 180 on the outer surface. The stripe members are located on opposite longitudinal sides of the top panel 150.

Figure 3:
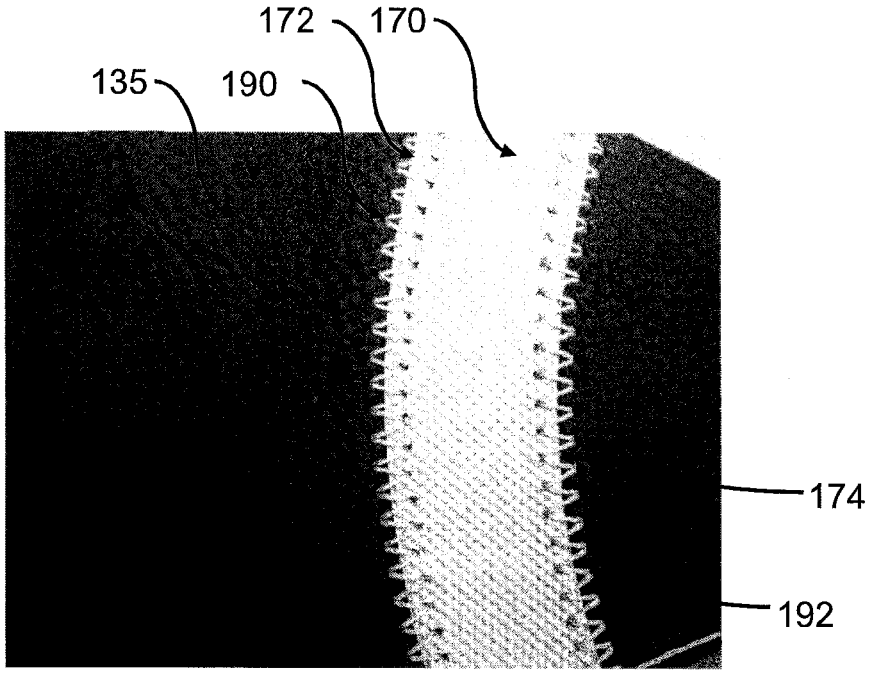
FIG. 3 is a picture of a natural leather cover panel showing a stripe member and two zig-zag stitched stripes using the coated thread of the present disclosure.

FIG. 3 is a picture showing a magnified view of the stripe member having stitchings with enhanced frictional characteristics. Visible here are the stripe member 170 and two raised stitchings, one raised stitching formed along each edge of the stripe member. Referring specifically to stripe member 170 though applying equally to the others, the stripe member has a first or interior stripe edge 172 and a second or exterior stripe edge 174, both of which are adjacent to the outer surface 135 of the panel. At least one raised stitching is present upon the stripe member. Here, two raised stitchings 190, 192 are illustrated. The first stitching 190 runs along the first stripe edge 172, and as shown here runs in a zig-zag pattern between the stripe member 154 and the outer surface 135. The stitching 190 is considered to be "upon" the stripe member when the stitching runs over the surface of the stripe member. The first stitch 190 runs from one side of the cover panel to the other side of the cover panel. The second stitching 192 runs along the second stripe edge 174, and also has a zig-zag pattern.

Each stitching is made from a tactile thread, such as a coated thread comprising internal fibers or braided fibers having an outer polymeric (e.g. latex) coating. In other embodiments, the stitching can consist of a single strand of high coefficient rubber or other extruded polymers. It should be noted that the term "stitching" is not required to be made from only one thread, and the stitching could be made from multiple threads. The disclosure should also not be construed as requiring all stitchings on a given stripe member to be formed from the same thread, though this can be done. Here, the first stitching is made using one coated thread, and the second stitching is made using a different coated thread.

Figure 4:
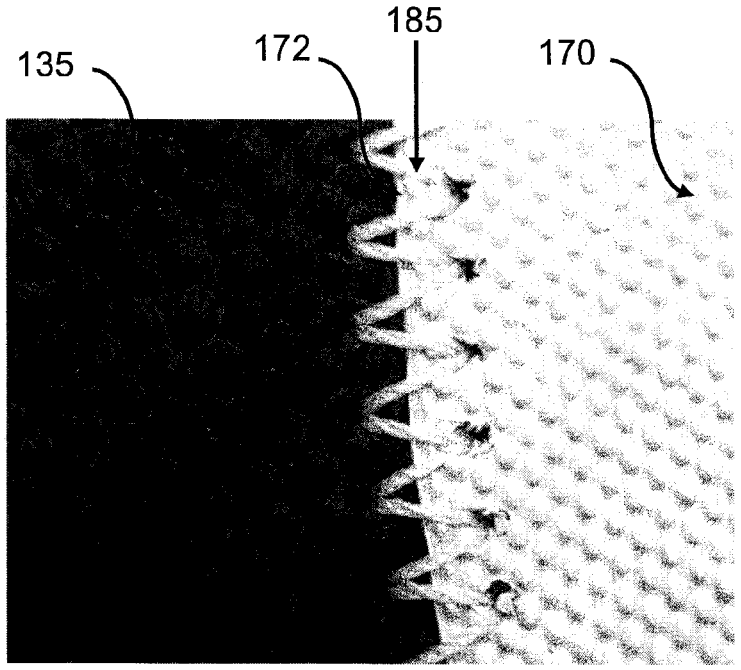
FIG. 4 is a picture providing an enlarged view of one of the stitchings of FIG. 3.

FIG. 4 is a magnified view of a portion of one of the stitchings. The first stripe edge 172 lies between the stripe member 170 and the outer surface 135 of the cover panel. The thread 185 forms a zig-zag pattern across the first stripe edge. It should also be noted that the cover panel has a texture that is different from the texture of the stripe member. This is seen in the different shape of the protrusions coming from the cover panel (which are "pebbled") and the stripe member (which are ellipsoidal). In some embodiments, the stripe member has a static coefficient of friction that is equal to, less than, or greater than the static coefficient of friction of the outer surface of the cover panel.

At least two different sets of embodiments are contemplated. In one set of embodiments, the stitching/thread has a static coefficient of friction which is greater than the static coefficient of friction of the cover panel, and the cover panel has a static coefficient of friction which is greater than the static coefficient of friction of the stripe member. In the other set of embodiments, the cover panel has a static coefficient of friction which is greater than the static coefficient of friction of the stitching/thread, and the stitching/thread has a static coefficient of friction which is greater than the static coefficient of friction of the stripe member. In both of these sets of embodiments, the stitching/thread has a static coefficient of friction which is greater than the static coefficient of friction of the stripe member.

Figure 5:
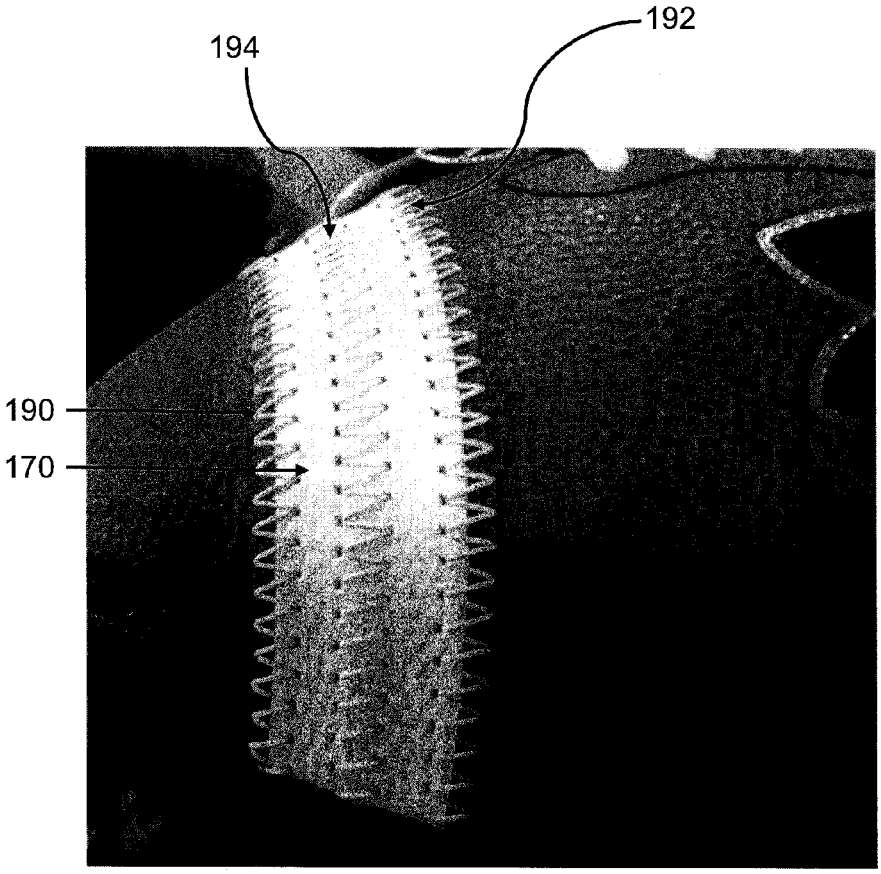
FIG. 5 is a picture of another embodiment, where three stitchings made from the thread of the disclosure are present upon the stripe member.

FIG. 5 is a picture of another embodiment. Here, there are three stitchings 190, 192, 194 using the coated thread. The third stitching 194 is located along the center of the stripe member 170.

Generally speaking, the present disclosure requires the presence of at least one stitching upon the stripe member made with the thread having a greater static coefficient of friction compared to either the outer surface of the cover panel or the stripe member. Embodiments having a total of one, two, three, four, five, or more stitchings are contemplated. For example, in embodiments with one stitching, the stitching could be located along the first stripe edge, along the second stripe edge, or along the center of the stripe member. For five stitchings, the additional stitchings could be located between the stitchings seen in FIG. 5. The stitching is made by sewing/weaving a pattern of stitches using the thread upon the cover panel/cover layer.

The various Figures above use a zig-zag design for the stitchings. However, generally any design is contemplated. For example, the design for the stitchings could be in the form of a straight line, a herringbone pattern, or a chevron (V–) pattern. If the design is directional, the stitchings can vary independently in the direction of the stitching. For example, the chevron pattern could be made pointing in one direction for one stitching and in the opposite direction for another stitching. This enhances the grip ability, feel, and possible aesthetics of the game ball.

A coated thread can be used for forming the stitchings upon the stripe member. The thread may comprise an elongated high strength fiber core which is coated with an enhanced grippable material. The fiber(s) can be formed from a high tensile strength polymer, such as a polyamide, polyester, metal, combinations thereof, etc. The outer coating can be compressible, soft, and resilient and provide an enhanced feel. The stitchings are sewn or woven using the coated thread. The thread can be coated with a coating so that the static coefficient of friction of the resulting stitching is greater than the static coefficient of friction of either the outer surface of the cover panel or the stripe member. This enhances the grip of the game ball. In certain embodiments, the thread is coated with a natural or synthetic rubber. Texture enhancing agents may also be included in the thread material.

The thread which forms the stitching can have a breaking strength of 83 newtons or higher; and/or an elongation at break of 40% to about 700%. The thread may be, for example, a polyester filament yarn of composition 280 dt/48 f, a twist count (Z) (T/m) of 335, a twist count (S) (T/m) of 560, a breaking strength of 91.5 Newtons, elongation at break of 40.5%, and a melting point of 240° C.

The thread can have a wide range of widths and thicknesses, and can be uniform or non-uniform in configuration. For example, the thread may have a cross-sectional diameter of 0.25 mm to 1.27 mm, including from about 0.4 to about 0.6 mm; or alternatively has a value of 1900+/−40 dtex. The thread is preferably white, tan, brown, or black in color, however other colors or color combinations are also possible, such as those matching certain team colors. Additionally, the thread may have certain exterior surface configurations in order to improve the gripping ability. For example, in certain embodiments, the outer surface of the thread is not smooth, and can be fibrous or textured.

The resulting stitching has a static coefficient of friction that is greater than the coefficient of friction of the cover panel and/or the stripe member. The coefficient of friction of the stitching can be affected by factors including the tackiness of the thread, the size of the thread, the stitching pattern used, and whether the thread is raised above the outer surface or flush against the outer surface. In particular embodiments, the thread itself has a static coefficient of friction that is greater than the coefficient of friction of the cover panel and/or the stripe member.

The static coefficient of friction for the thread, the cover panel, and the stripe member can be measured in accordance with ASTM D1894, entitled "Standard Test Method for Static and Kinetic Coefficients of Friction of Plastic Film and Sheeting." Generally, a sample of the desired surface to be tested is attached to the bottom of a metal sled, which is then run across a test surface for a given distance. The initial force to start the sled and the average force over the distance is recorded. The force measuring device should be able to measure frictional force to +/−5% of its value. The measured forces are divided by the sled weight to obtain the static and kinetic coefficient of friction. It should be recognized that the coefficient of friction for the thread should be measured using a film made from the same material as the exterior surface of the thread. For example, to measure the coefficient of friction of the stitching, a sample of the cover layer with the stripe member and the stitching can be cut out and attached to the bottom of the metal sled. For purposes of this application, the test surface upon which the metal sled is run to measure the static coefficient of friction is the "pebbled" side of a piece of Pattern 62 glass (not the smooth side of the glass).

The stripe member itself can be formed from a polyurethane, a polyvinyl chloride, a rubber, leather (natural or synthetic), a polymer, or an elastomer. The stripe member is attached to the cover panel through known means, e.g. adhesives, thermal bonding, press fitting, etc. The stripe member can also be painted on, or applied as a coating. The stripe member can be of any shape, e.g. hexagonal, arcuate, etc. The stripe member can be of any color, e.g. white, black, or combinations thereof. In particular embodiments, the static coefficient of friction of the stripe member is equal to or less than the static coefficient of friction of the outer surface of the cover panel.

The various components of the game ball can be made using materials and methods known in the art.

The inflatable bladder of the game ball holds air or a gas or a mixture thereof. The bladder, when properly inflated, provides the primary resilience to a finished football. The bladder can be made from latex or butyl rubber and fitted with a valve stem (not shown) for introducing air into the ball as inflated pressure to the structure. Butyl rubber bladders retain air for longer periods of time and offer an excellent combination of contact quality and air retention. Latex bladders tend to provide better surface tension, give proper bounce, feel softer, and provide same angle rebounce characteristics. Natural latex rubber bladders usually offer the softest feel and response, but do not provide the best air retention because they contain micro-pores. Micro-pores are tiny holes that slowly allow air to escape. Balls with natural rubber bladders need to be reinflated (at least once a week) more often than balls with butyl bladders (stay properly inflated for weeks at a time) due to these micro-pores. Some balls use carbon-latex bladders, where carbon powder is added to the latex to plug some of the microscopic holes that are in pure latex bladders. Carbon latex bladders retain air longer than bladders made from latex rubber. Some manufacturers also use bladders made from multiple layers of polyurethane. The bladder can be of appropriate thickness as to reasonably protect against loss of air due to puncture, temperature change, or other foreseeable occurrences.

The bladder may have a reinforcing winding layer (not shown). The winding layer is typically formed of monofilaments of polyester and/or nylon and is wrapped around the bladder (not shown) in either a pre-determined pattern or a random fashion to help the final ball retain its shape under typical inflation pressure and under the stresses of use. The windings can be coated with an adhesive which allows them to adhere to the bladder and also to each other.

The cloth liner, foam liner, and cover layer may be formed from materials known in the art. For example, the foam liner can be made from styrene butadiene rubber (SBR); polybutadiene rubbers; polyurethane foams; ethylene vinyl acetate (EVA) foams; polypropylene foams; ethylene propylene diene monomer (EPDM); and combinations and blends thereof.

The cover panels of the game ball can be made using leather, or a rubber, or some other polymeric material. Leather is a material created through the tanning of hides and skins of animals, frequently cattle hide. The tanning process converts the putrescible skin or hide into a durable, long-lasting and versatile natural material suitable for various uses. Generally, four different types of leather exist having different characteristics, i.e. full-grain, top-grain, corrected grain, and split grain. Full-grain leather is a common material used to form the cover of game balls such as footballs. In this regard, full-grain leather is formed from animal hide where only the hair has been removed, and the natural grain (texture) has been left on. Full-grain leather is thick. In contrast, with top-grain leather the natural grain has been removed. Full-grain leather is very desirable to use because of its durability and minimal chemical treatment. Full-grain leather also has a "pebbly" texture which enhances the grippability of the surface. It is specifically contemplated that the game balls described herein use full-grain leather panels to make the cover layer. Of course, synthetic leather panels or other polymeric cover layers are also contemplated.

The cover panels and game balls of the present disclosure can be made using conventional methods. In particular, the stripe member is first attached to the outer surface of the cover panel, and the stitch(es) using the coated thread are then sewn.

Figure 6:
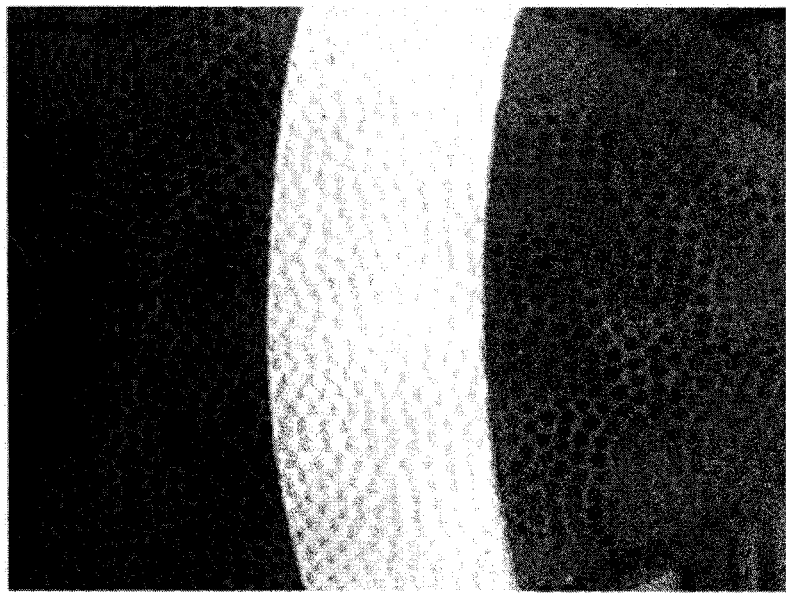
FIG. 6 is a picture showing a leather panel with a stripe prepared according to conventional methods and having the same texture as the cover panel.

It should be noted that in embodiments, the texture of the stripe member is different from the texture of the outer surface of the cover panel. This can be accomplished using the methods described in U.S. Provisional Patent Application Ser. No. 61/710,235, filed Oct. 5, 2012, the entirety of which is hereby incorporated by reference. Generally, a textured stamping plate is used to create a textured area on the full-grain leather panel. The texture within the textured area is different from the original texture of the full-grain leather panel. An ink or paint is then applied to this textured area to form the stripe member. This difference can be seen when comparing FIG. 4 to FIG. 6. FIG. 4 is an embodiment of the present disclosure, and the difference in texture between the stripe member 170 and the cover panel 135 is visible. FIG. 6 is a conventionally prepared football, where both the stripe member and the cover panel have the same pebbled texture.

Several variations on the stripe members and the stitching pattern/design are illustrated in FIGS. 7-24.

Figure 7:
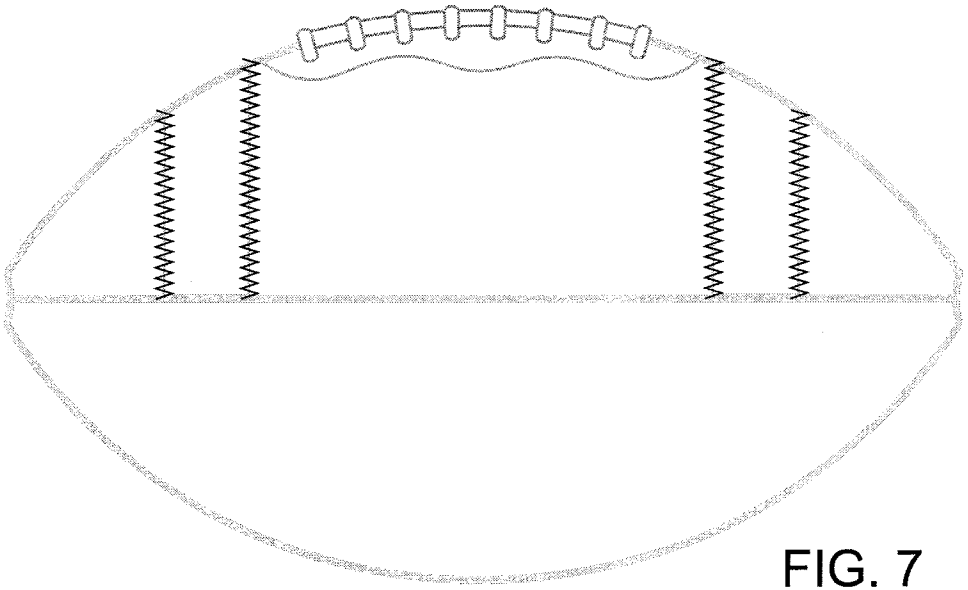
FIG. 7 is a side view of a football having frictional stitchings (2 per stripe, zigzag design).
Figure 8:
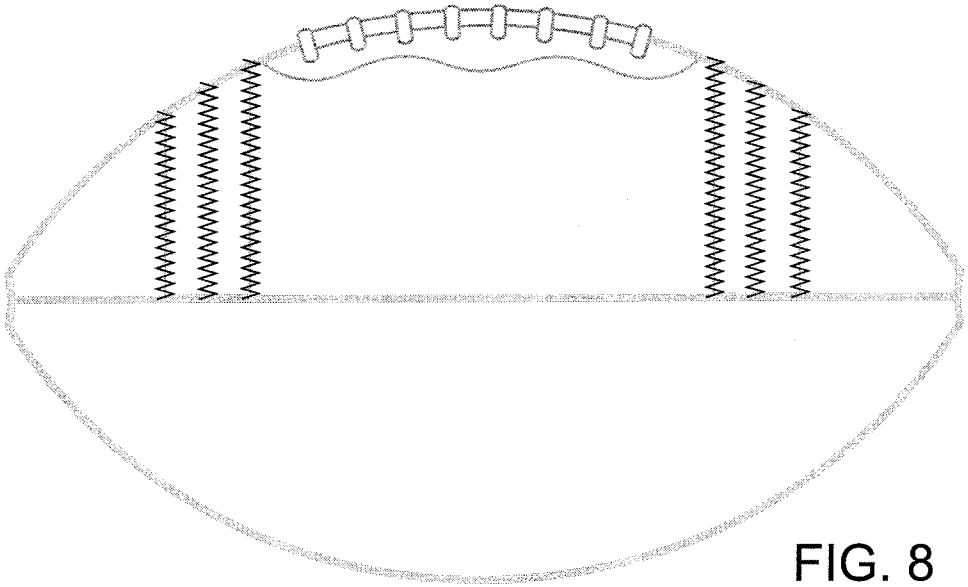
FIG. 8 is a side view of a football having frictional stitchings (3 per stripe, zigzag design).
Figure 9:
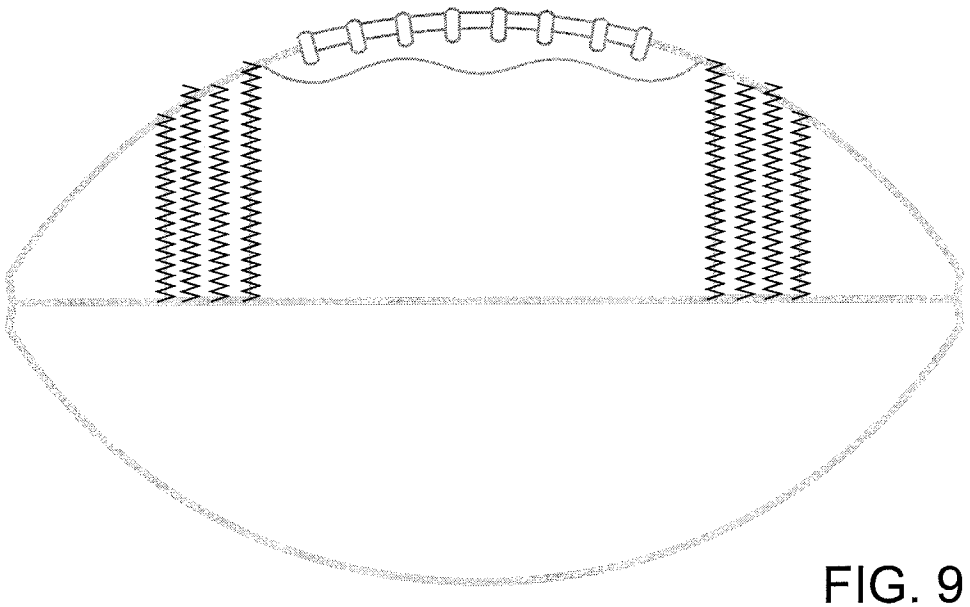
FIG. 9 is a side view of a football having frictional stitchings (4 per stripe, zigzag design).

In FIGS. 7-9, a zigzag design is used for the stitchings. As illustrated here, there are 2-4 stitchings per stripe.

Figure 10:
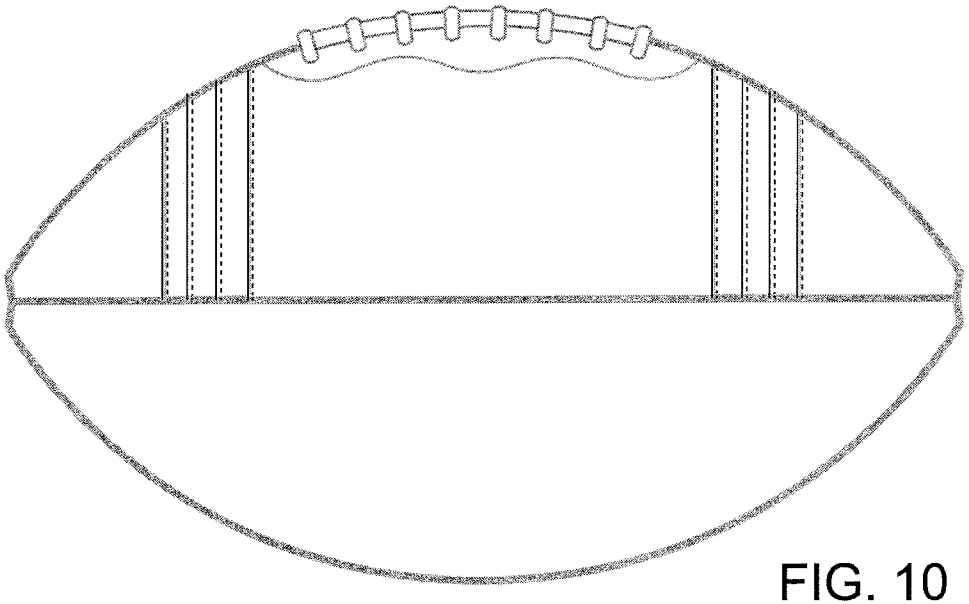
FIG. 10 is a side view of a football having 4 frictional stitchings (straight design), where each stripe is made from three smaller stripe members.

In FIG. 10, the overall stripe at each end is made up of three smaller stripe members (denoted by solid lines for their edges), and there are four straight stitchings per stripe (dotted lines). Note that one of the stitchings is not upon a stripe member.

Figure 11:
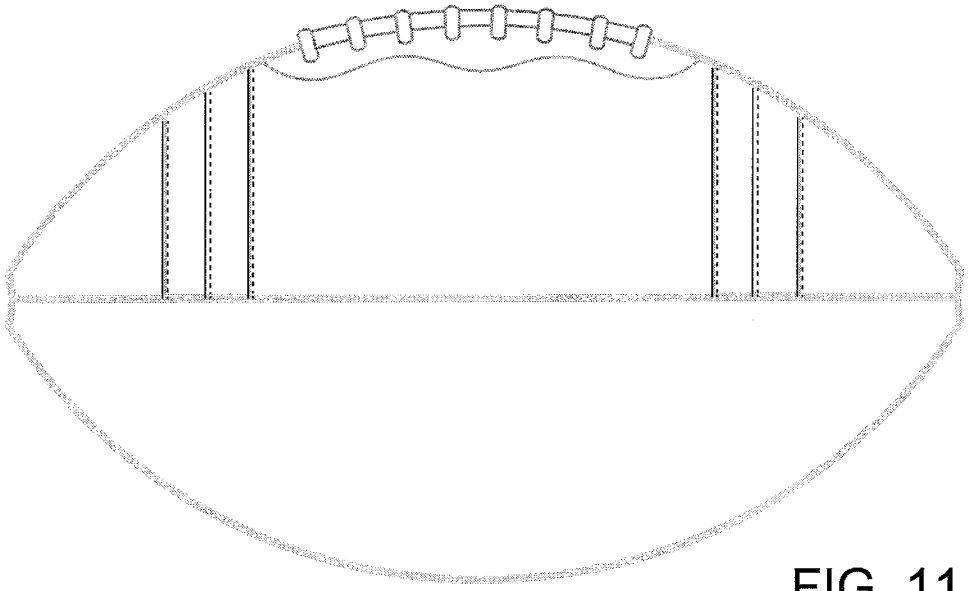
FIG. 11 is a side view of a football having 3 frictional stitchings (straight design), where each stripe is made from two smaller stripe members.

In FIG. 11, the overall stripe at each end is made up of two smaller stripe members (denoted by solid lines for their edges), and there are three straight stitchings per stripe (dotted lines). Note that one of the stitchings is not upon a stripe member.

Figure 12:
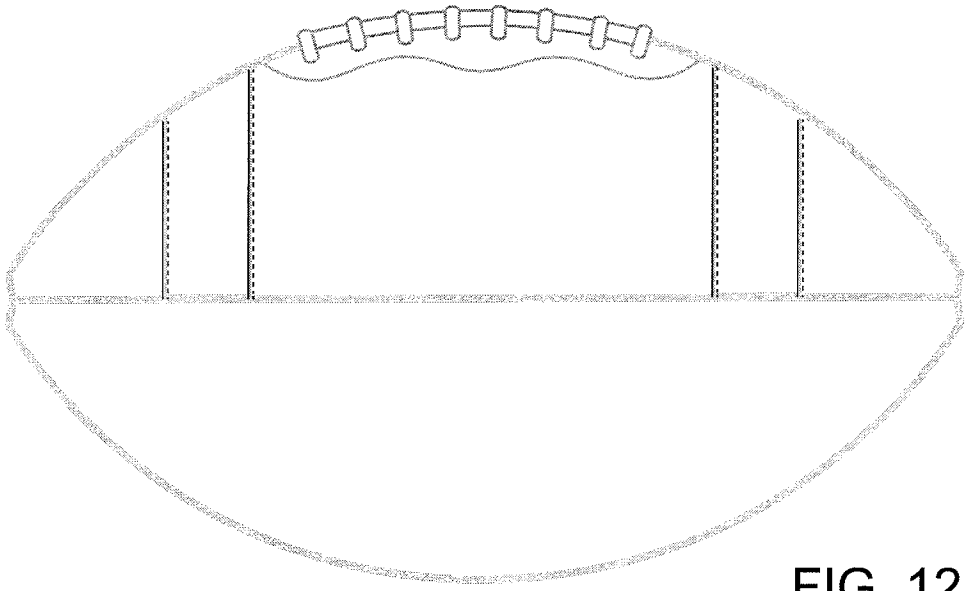
FIG. 12 is a side view of a football having frictional stitchings (2 per stripe, straight design).

In FIG. 12, straight stitchings are used (dotted lines). Note that one of the stitchings is not upon a stripe member (denoted by solid lines for the edges).

Figure 13:
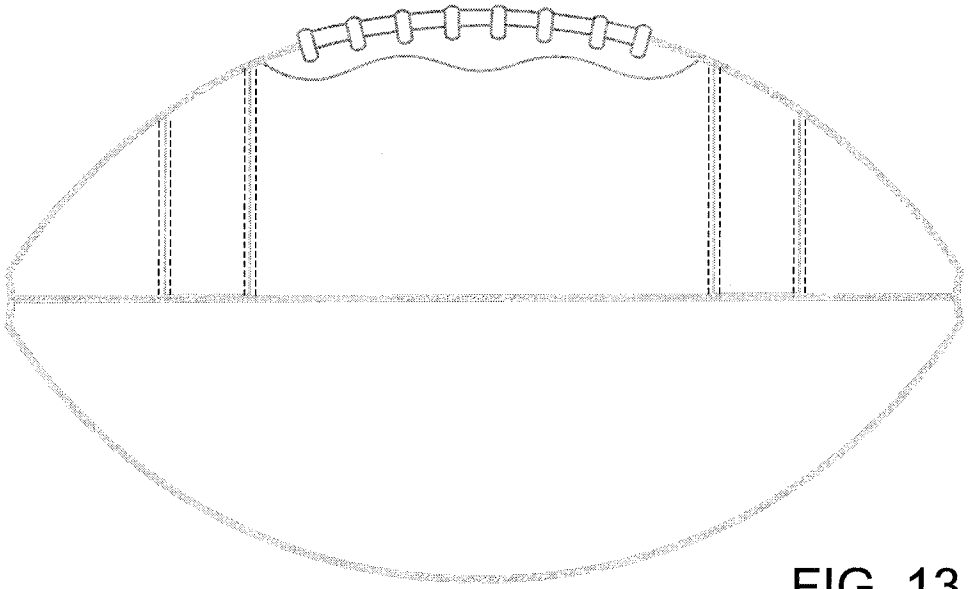
FIG. 13 is a side view of a football having frictional stitchings (4 per stripe, straight design).

In FIG. 13, there are four stitchings. Note that two of the stitchings are not upon the stripe member.

Figure 14:
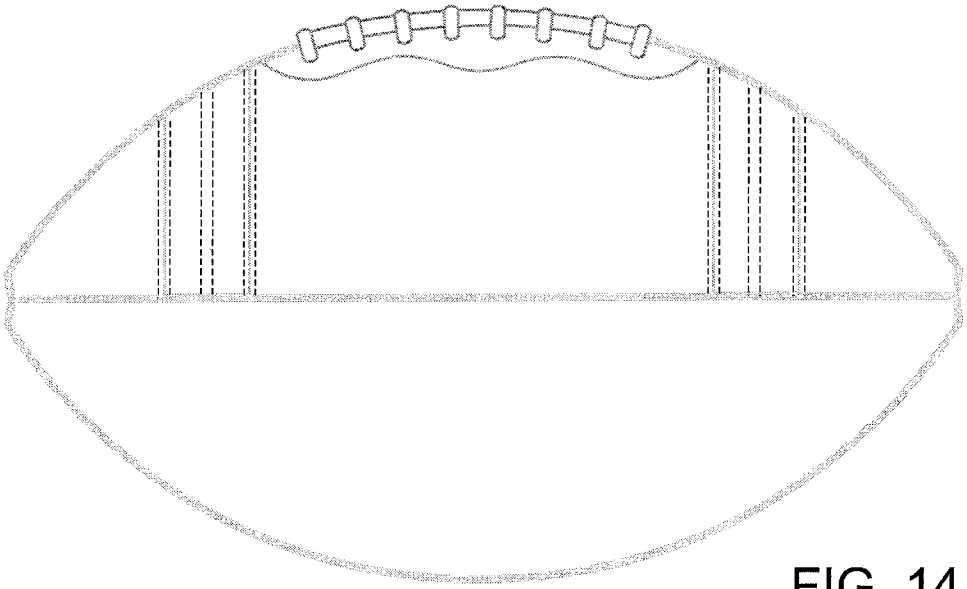
FIG. 14 is a side view of a football having frictional stitchings (6 per stripe, straight design).

In FIG. 14, there are six stitchings. Note that two of the stitchings are not upon the stripe member.

Figure 15:
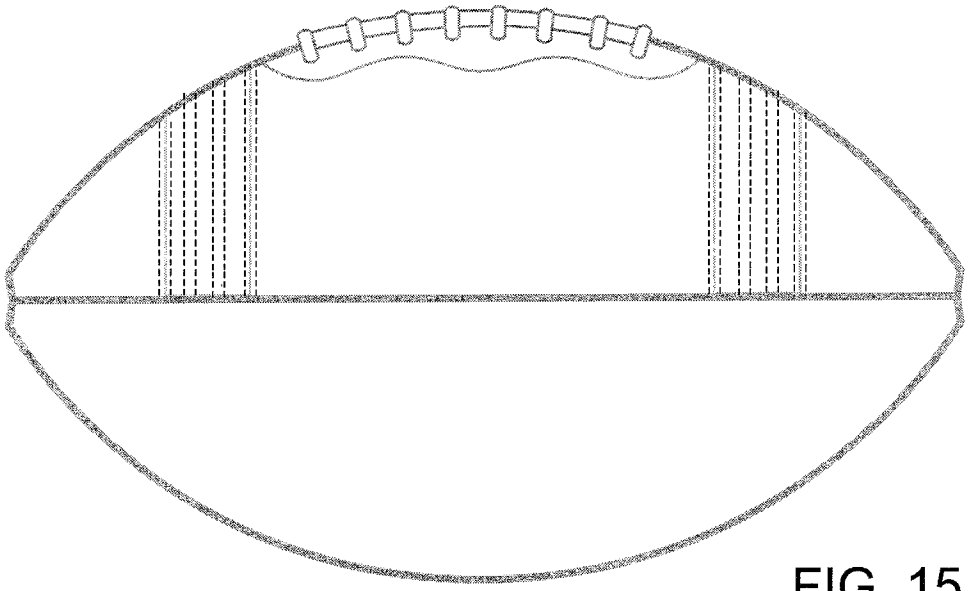
FIG. 15 is a side view of a football having frictional stitchings (8 per stripe, straight design).

In FIG. 15, there are eight stitchings. Note that two of the stitchings are not upon the stripe member.

Figure 16:
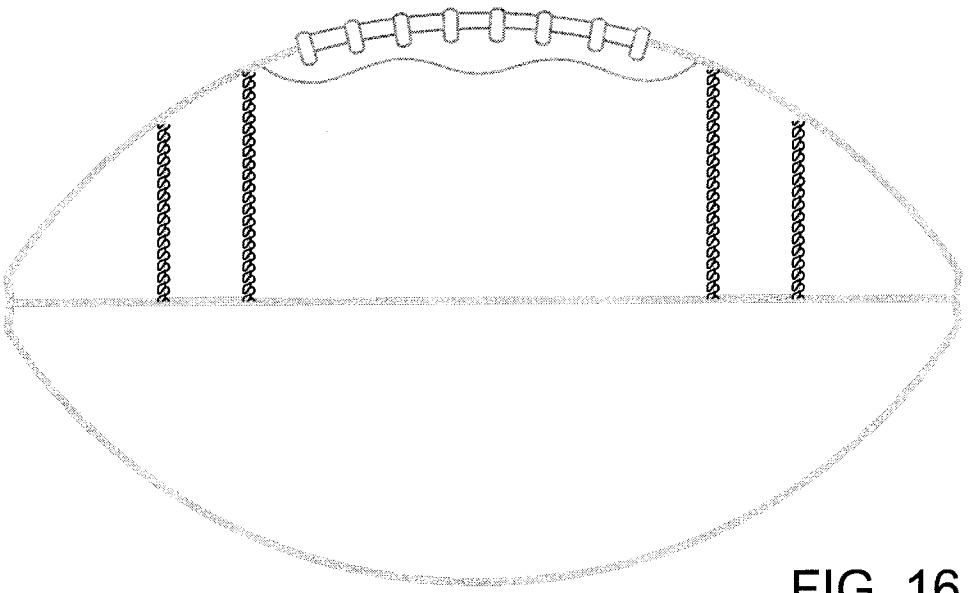
FIG. 16 is a side view of a football having frictional stitchings (2 per stripe, zipper or serpentine design).
Figure 17:
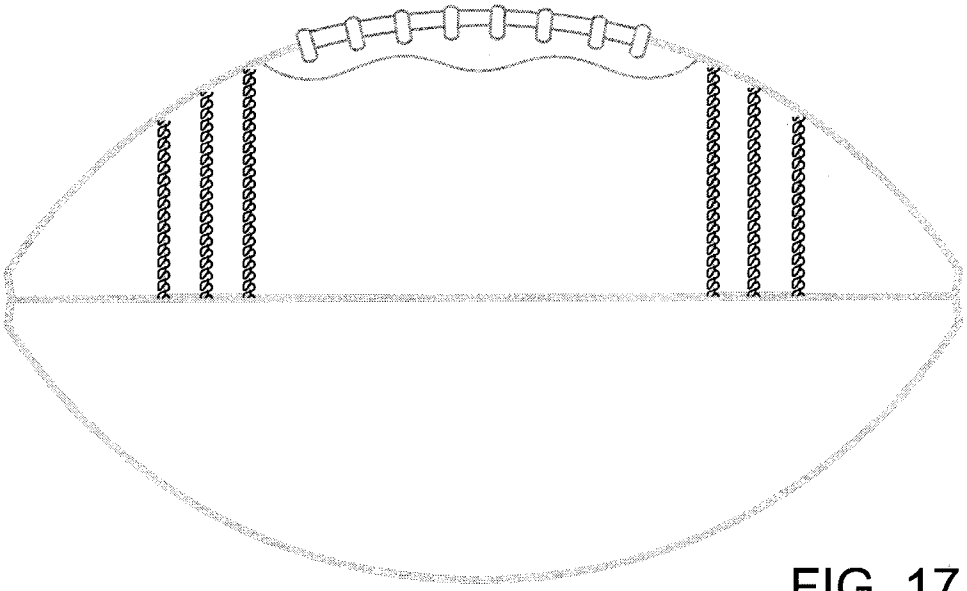
FIG. 17 is a side view of a football having frictional stitchings (3 per stripe, zipper or serpentine design).
Figure 18:
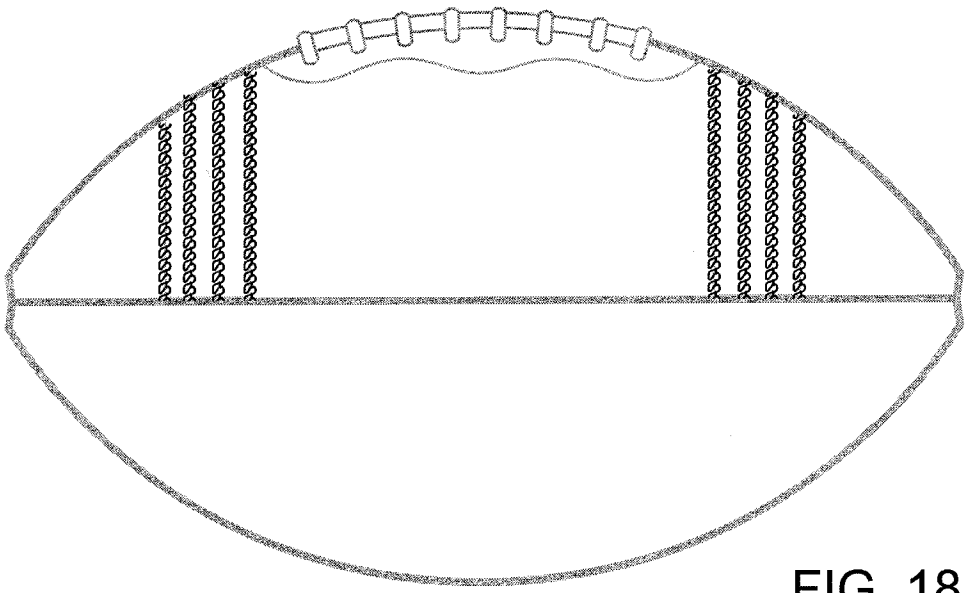
FIG. 18 is a side view of a football having frictional stitchings (4 per stripe, zipper or serpentine design).

In FIGS. 16-18, a zipper or serpentine design is used for the stitchings. As illustrated here, there are 2-4 stitchings per stripe.

Figure 19:
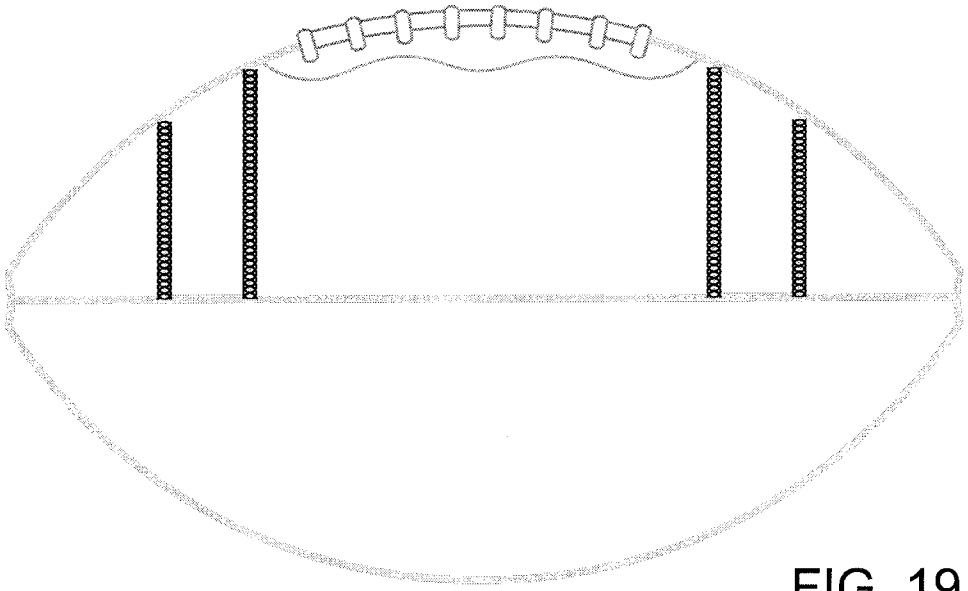
FIG. 19 is a side view of a football having frictional stitchings (2 per stripe, loop design).
Figure 20:
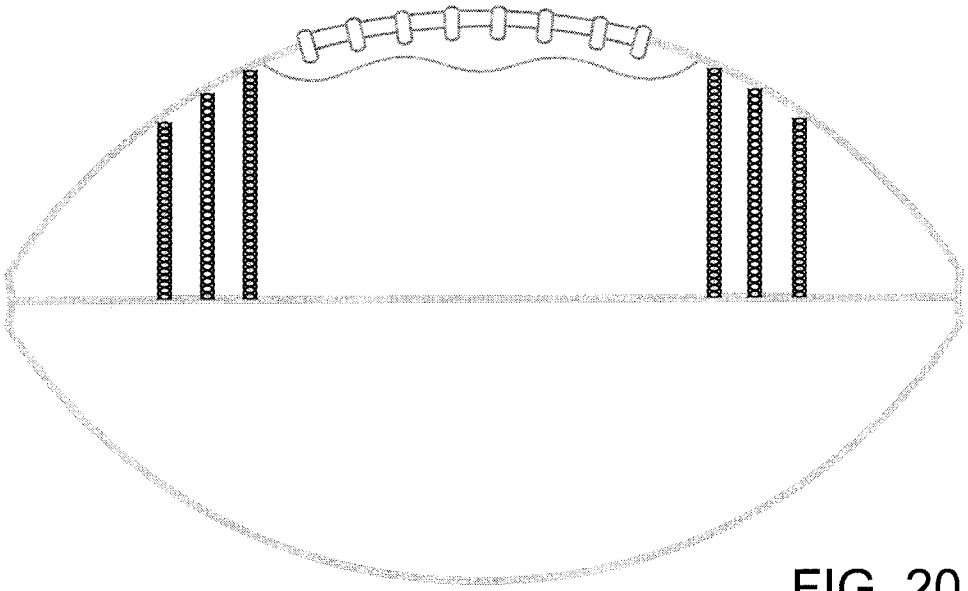
FIG. 20 is a side view of a football having frictional stitchings (3 per stripe, loop design).
Figure 21:
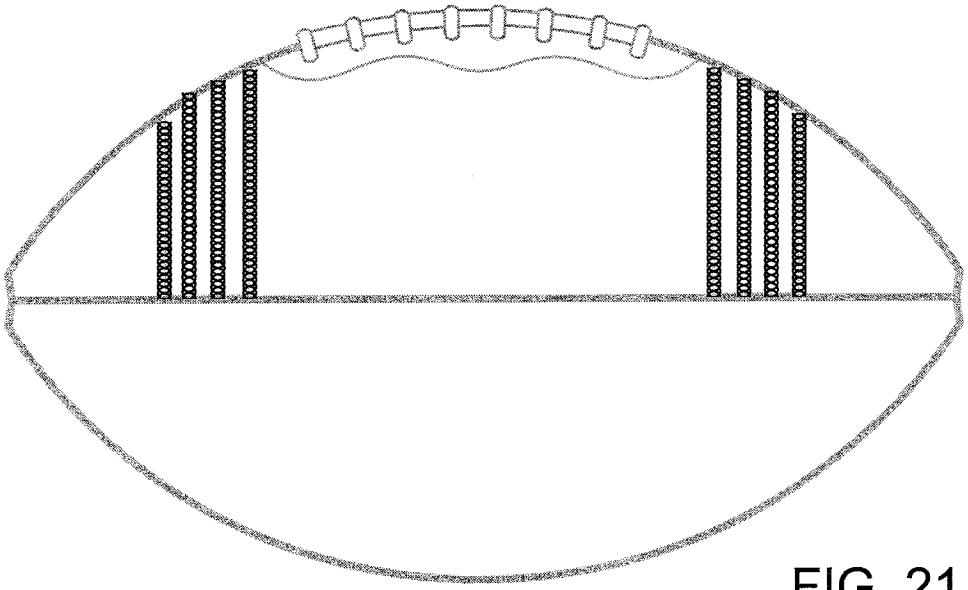
FIG. 21 is a side view of a football having frictional stitchings (4 per stripe, loop design).

In FIGS. 19-21, a loop design is used for the stitchings. As illustrated here, there are 2-4 stitchings per stripe.

Figure 22:
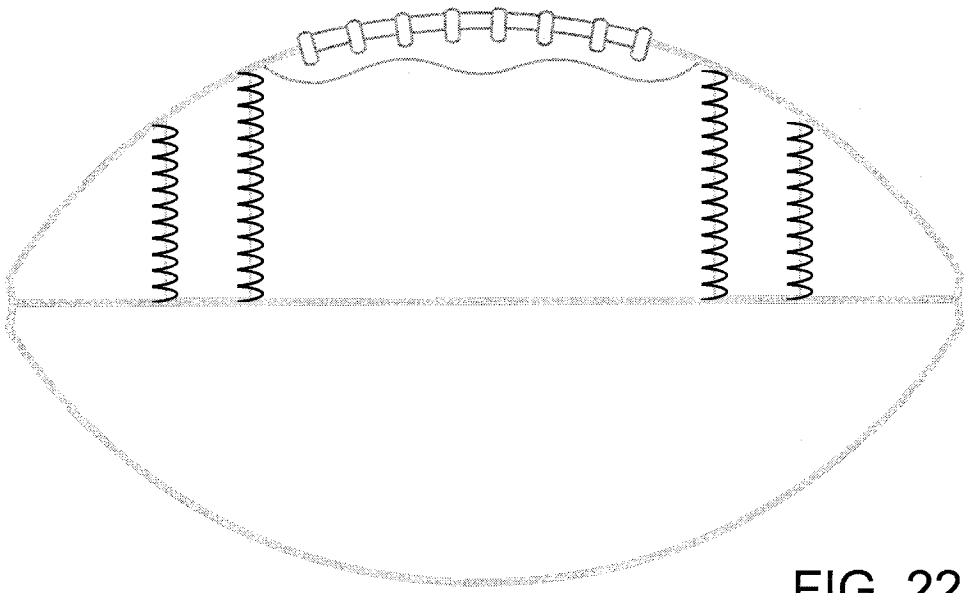
FIG. 22 is a side view of a football having frictional stitchings (2 per stripe, arch design).
Figure 23:
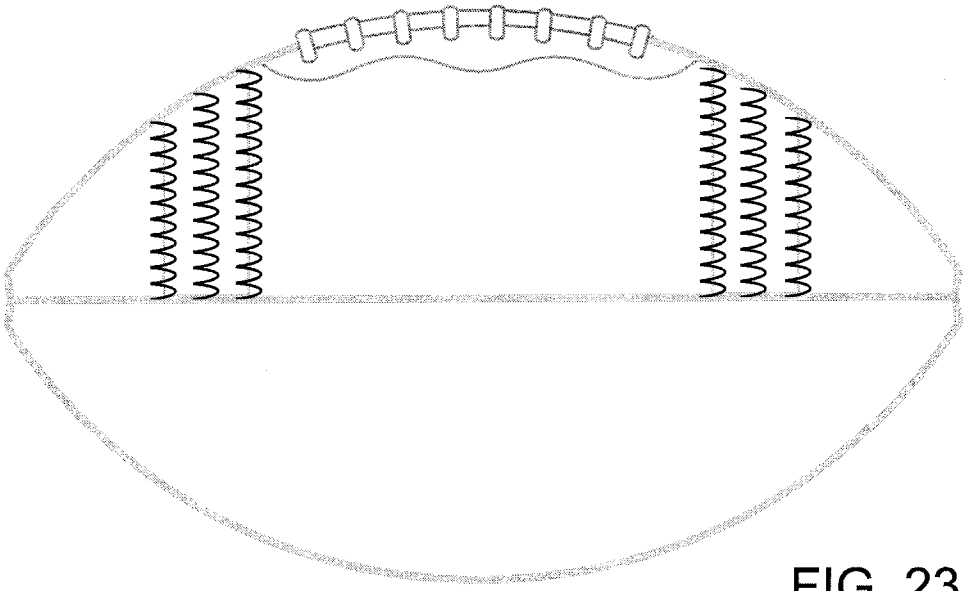
FIG. 23 is a side view of a football having frictional stitchings (3 per stripe, arch design).
Figure 24:
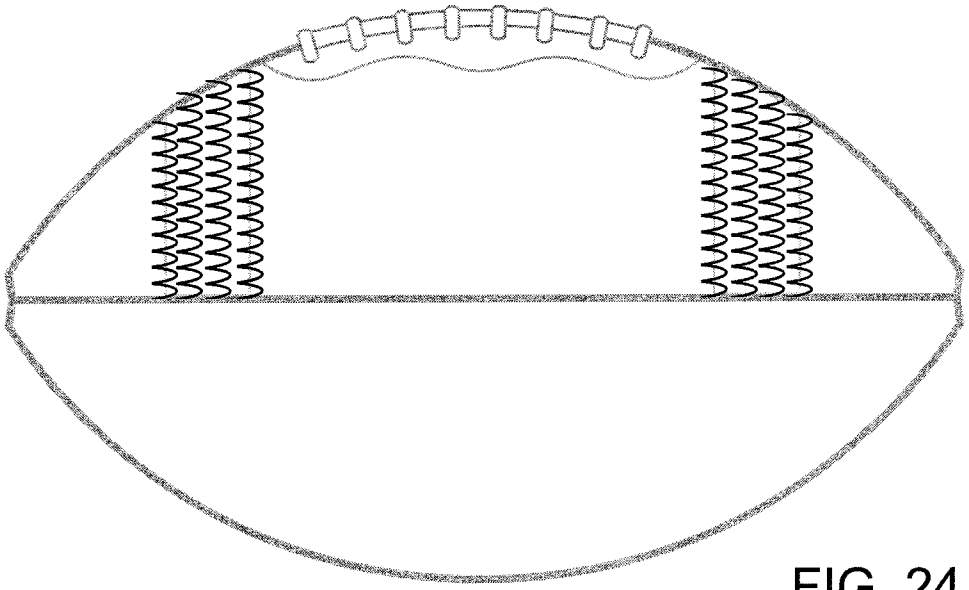
FIG. 24 is a side view of a football having frictional stitchings (4 per stripe, arch design).

In FIGS. 22-24, an arch design is used for the stitchings. As illustrated here, there are 2-4 stitchings per stripe. This improves the aesthetics and the overall feel and/or grippability The following examples are for purposes of further illustrating the present disclosure. The examples are merely illustrative and are not intended to limit the balls made in accordance with the disclosure to the materials, conditions, or process parameters set forth therein.

EXAMPLES

A Comparative Sample and a Test Sample were tested according to ASTM D1894. The Comparative Sample was a square of approximately 8 inches by 8 inches, and consisted solely of a bare painted skin, which corresponded to a painted stripe. The Test Sample measured approximately 8.5 inches by 9 inches, and consisted of parallel rows of thread stitched in a straight design, each row approximately one-sixteenth inch apart, also on top of a painted skin. Each Sample was taped to the bottom of a sled weighing 200 grams. The test surface was a piece of Pattern 62 glass measuring 16 inches by 6 inches by one-eight inch (thickness), with the pebbled side contacting the Sample.

The sled was then dragged across the pebbled side of the Pattern 62 glass at least five times to increase the precision of the measurements. The Test Sample was run in both the machine direction (parallel to the stitches) and in the cross direction (perpendicular to the stitches). The measured static and kinetic coefficients of friction are shown below in Table 1.

| Example | Average Static Coefficient | Average Kinetic Coefficient |
|---|---|---|
| Comparative Sample | 0.241 | 0.216 |
| Test Sample - Machine | 0.274 | 0.283 |
| Test Sample - Cross | 0.263 | 0.256 |

The Test Sample having stitchings had a higher static coefficient of friction than the Comparative Sample (only painted) in both the machine and cross directions. The Test Sample having stitchings also had a higher kinetic coefficient of friction than the Comparative Sample in both the machine and cross directions.

The methods, game balls, and devices of the present disclosure have been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A game ball, comprising:

an inflatable bladder; and a cover layer surrounding the bladder, the cover layer being formed from a plurality of cover panels;

wherein at least one of the cover panels includes (i) a first stripe member attached to an outer surface of the cover panel and having a texture different from a texture of the outer surface of the cover panel, the first stripe member having a first stripe edge and a second stripe edge adjacent the outer surface, and (ii) at least one stitching upon the first stripe member formed using a thread coated with a texture enhancing polymer, the stitching having a static coefficient of friction greater than either the static coefficient of friction of the outer surface of the cover panel or the static coefficient of friction of the first stripe member, when measured according to ASTM D1894 using the pebbled side of a Pattern 62 glass as the test surface.

2. The game ball of claim 1, wherein the at least one cover panel has at least a first stitching along the first stripe edge and a second stitching along the second stripe edge.

3. The game ball of claim 2, wherein the first stitching runs along the first stripe edge in a zig-zag pattern between the first stripe member and the outer surface of the at least one cover panel, and the second stitching runs along the second stripe edge in a zig-zag pattern between the first stripe member and the outer surface of the at least one cover panel.

4. The game ball of claim 2, wherein the at least one cover panel has three stitchings, the third stitching being located along the center of the first stripe member.

5. The game ball of claim 1, wherein the first stripe member has a static coefficient of friction that is equal to, less than, or greater than the static coefficient of friction of the outer surface of the cover panel.

6. The game ball of claim 1, wherein the first stripe member is formed from a polyurethane, a polyvinyl chloride, a rubber, or an elastomer.

7. The game ball of claim 1, wherein the at least one cover panel further includes a second stripe member located at an opposite end of the cover panel from the first stripe member.

8. The game ball of claim 1, wherein the cover layer is formed from a total of four cover panels, and two of the cover panels include the first stripe member and the at least one stitching.

9. The game ball of claim 1, wherein the first stripe member has a different texture from the outer surface of the at least one cover panel.

10. The game ball of claim 1, wherein the thread is a coated thread comprising a fiber core and an outer polymeric coating.

11. The game ball of claim 10, wherein the outer polymeric coating is a natural or synthetic rubber.

12. The game ball of claim 1, wherein the thread has a breaking strength of 83 newtons or higher, and an elongation at break of 40% to about 700%.

* * * * *